US011607001B2

(12) United States Patent
Takazawa

(10) Patent No.: US 11,607,001 B2
(45) Date of Patent: Mar. 21, 2023

(54) WIND NOISE REDUCTION APPARATUS

(71) Applicant: Takashi Takazawa, Aichi (JP)

(72) Inventor: Takashi Takazawa, Aichi (JP)

( * ) Notice: Subject to any disclaimer, the term of this patent is extended or adjusted under 35 U.S.C. 154(b) by 234 days.

(21) Appl. No.: 17/050,746

(22) PCT Filed: Aug. 15, 2019

(86) PCT No.: PCT/JP2019/032044
§ 371 (c)(1),
(2) Date: Oct. 26, 2020

(87) PCT Pub. No.: WO2020/121595
PCT Pub. Date: Jun. 18, 2020

(65) Prior Publication Data

US 2021/0227918 A1 Jul. 29, 2021

(30) Foreign Application Priority Data

Dec. 10, 2018 (JP) ..... JP2018-230485

(51) Int. Cl.
*A42B 3/16* (2006.01)

(52) U.S. Cl.
CPC ..... *A42B 3/163* (2013.01); *A42B 3/16* (2013.01); *A42B 3/166* (2013.01)

(58) Field of Classification Search
CPC ..... A42B 3/163; A42B 3/16; A42B 3/166
See application file for complete search history.

(56) References Cited

U.S. PATENT DOCUMENTS 830,439 A * 9/1906 James ..... A42B 3/166 2/423
2,140,630 A * 12/1938 Illguth ..... A42B 3/163 2/209
2,991,478 A * 7/1961 Zbikowski ..... A42B 3/10 2/421
5,323,493 A 6/1994 Ogiba
(Continued)

FOREIGN PATENT DOCUMENTS

EP 1329168 A1 7/2003
EP 1696757 A1 9/2006
(Continued)

*Primary Examiner* — Khaled Annis
(74) *Attorney, Agent, or Firm* — Locke Lord LLP

(57) ABSTRACT

There is provided a wind noise reduction apparatus that has a simple structure to suppress vibration caused by an air current generated in the course of protection against the wind, while not reducing ambient sound. A wind noise reduction apparatus 1 includes a windshield portion 2 having a first surface 21 that is defined by four sides of a front end 23, a rear end 24, an upper end 25 and a lower end 26 and that is arranged to face an ear front surface and a second surface 22 that is arranged on an opposite side to the first surface; one or multiple support portions 3 stood upright from the first surface 21 of the windshield portion 2; and a catching portion 4 including an insertion hole or insertion opening 44 that is used to hold a chin strap B of a helmet and that is located between a front edge and a rear edge 33 of the support portion 3. The windshield portion 2 is supported by a three or more supporting point structure of the front end 23 of the windshield portion 2 and the support portion 3.

6 Claims, 20 Drawing Sheets

(56) References Cited

U.S. PATENT DOCUMENTS 5,438,706 A * 8/1995 Lambur ..... A61F 9/029 2/13
5,477,564 A * 12/1995 Tichy ..... A42B 3/08 2/209
5,850,637 A * 12/1998 Lewis ..... G02C 11/00 351/122
6,029,282 A * 2/2000 Buschman ..... A42B 3/163 128/866
6,029,769 A * 2/2000 Tichy ..... A61F 11/06 2/209
6,286,149 B1 * 9/2001 Whitaker ..... A42B 3/163 2/209
6,325,173 B1 * 12/2001 Miller ..... H04R 1/086 181/136
6,347,412 B1 * 2/2002 Dorman ..... A42B 3/163 2/209
7,862,165 B2 * 1/2011 Hobbs ..... G02C 7/06 351/44
2002/0104152 A1 * 8/2002 Schmitt ..... A42B 1/0188 2/423
2004/0040072 A1 3/2004 Mizuno
2007/0136921 A1 6/2007 Tiegs
2009/0300827 A1 * 12/2009 Mizuno ..... A61F 11/06 2/423
2015/0090522 A1 4/2015 Weissner
2021/0227918 A1 * 7/2021 Takazawa ..... A42B 3/163

FOREIGN PATENT DOCUMENTS

JP 2002-156613 A 5/2002
JP WO2007/077983 A1 7/2007
JP 2008-289832 A 12/2008
JP 3172282 U 12/2011
JP 2013-204184 A 10/2013
WO 2002/028212 A1 4/2002
WO 2005/060777 A1 7/2005
WO 2008/020359 A2 2/2008

* cited by examiner

WIND NOISE REDUCTION APPARATUS

TECHNICAL FIELD

The present disclosure relates to a wind noise reduction apparatus.

BACKGROUND

When a person with ears exposed acts on, for example, a bicycle, a horse or a deck on a ship or when a person works outdoors in a windy day, the person hears the wind from the front side hitting against the auricle, as wind noise. This may interfere with smooth communication by conversion, cause problems or troubles in outdoor activity or work and cause the person not to recognize a danger behind the person.

On the trend of increasing popularity of bicycle touring, it has been reported that the wind noise of 85 dB was recorded when a person rode a bicycle at a speed of 10 miles (16 km) per hour as a result of wind tunnel test in the United States. According to US Occupational Safety and Health Administration, exposure to the noise of 85 dB for 8 hours causes the noise-induced hearing loss. Riding a bicycle at the speed of 10 miles (16 km) per hour is likely to cause the noise-induced hearing loss. As an ordinary case, a person may ride a bicycle on a downslope at a speed of 30 miles (48 kilometers) per hour against the wind at a speed of 10 miles (16 kilometers) per hour. In this case, the noise of 108 dB was recorded in the test described above. According to "Guideline for the Prevention of Noise-Induced Impairments" (Oct. 1, 1992) formulated by the Ministry of Health, Labor and Welfare of Japan, "a worker must wear an ear protection" during a work at a location close to a sound source of 90 dB or more even in a workplace other than an indoor workplace. The noise-induced health hazard is a significant problem. In such environments, various apparatuses for reducing the wind noise have been examined.

A disclosure described in Patent Literature 1 provides an apparatus including a windshield A and a sound insulating board placed in front of the user's ear. The windshield A is provided to cover the user's ear lobe from the front side or from the front side to the lateral side, and the sound insulating board is placed between the user's earhole and the windshield. Another windshield B is additionally placed in front of the windshield A and below the helmet as needed basis. This configuration is expected to cause the wind from the front side to be blocked by the windshield A and not to reach the user's ear lobe or earhole and thereby cause the user not to hear the wind noise, which is heard by the user without wearing the apparatus.

A disclosure described in Patent Literature 2 provides a wind noise preventing apparatus configured to cover an entire area or part of a human head including at least ear parts with a view to reducing the wind noise. The apparatus causes the auricle and the cheek bone to be covered with a cover member having a surface of hair-like body such as wool yarn or fur. This configuration is expected to suppress the air current from entering the ear canal and reduce the bone conduction sound and the secondary sound in the vicinity of the auricle and the cheek bone, so as to prevent generation of the wind noise.

CITATION LIST

Patent Literature

Patent Literature 1: Japanese Unexamined Patent Republication No. 2007-077983

Patent Literature 2: Japanese Patent No. 5945866

SUMMARY

Technical Problem

In the apparatus of reducing the wind noise described in Patent Literature 1 is, however, neither a lower end nor a rear end of the windshield is fixed, while an upper end of the windshield is fixed to the helmet. An air eddy generated by the exposure of the windshield to the air current from the front side in a location away from the fixation part of the windshield causes vibration of the windshield and generates a high frequency sound. This configuration thus additionally needs the sound insulating board. This Patent Literature also discloses a method of fixing a windshield to a wide chin strap. The soft chin strap serving as a fixed point fails to suppress vibration of the windshield caused by the air eddy. Moreover, the configuration of not fixing the lower end or the rear end of the windshield also fails to suppress vibration of the windshield caused by the air eddy.

Employing a hard and thick block-like structure for preventing vibration to the configuration disclosed in this Patent Literature may reduce the vibration. This method, however, increases both the cost and the weight of the apparatus and is thus not practical.

The noise preventing apparatus described in Patent Literature 2 is configured to cover the entire area or part of the human head including at least the ear parts with a view to reducing the wind noise. This configuration is, however, likely to impair the heat radiating function from the human head and increase the body temperature. Furthermore, this configuration is likely to damage the feeling of freedom and the exhilarating feeling when the user enjoys an outdoor activity in the summer. This configuration additionally reduces the ambient sound in addition to the wind noise. During bicycle touring, the user accordingly may not recognize a vehicle approaching behind and may have a difficulty in smooth in-group communication.

An object of the present disclosure is to provide a wind noise reduction apparatus that has a simple structure to suppress vibration caused by an air current generated in the course of protection against the wind, while not reducing ambient sound.

Solution to Problem

In order to solve the problem described above, according to a first aspect of the present disclosure, there is provided a wind noise reduction apparatus comprising a windshield portion having a front end, a rear end, an upper end, a lower end, a first surface arranged to face an ear front surface of a human face, and a second surface arranged on an opposite side to the first surface, wherein an upper side, a lower side, a front side, a rear side, an inner side and an outer side are specified by directions relative to a human head; one or multiple support portions stood upright from the first surface; and a catching portion including an insertion hole or insertion opening that is used to hold a chin strap of a helmet and that is located between a front edge and a rear edge of the support portion.

The "upper side, lower side, front side, rear side, inner side and outer side" are specified by respective directions for a user when the user wears the wind noise reduction apparatus. The "inner side and outer side" are specified such that a side closer to the wearer's body is the inner side and that a side farther from the wearer's body is the outer side.

The "front end", the "rear end", the "upper end" and the "lower end" respectively denote a front side, a rear side, an upper side and a lower side of the first surface of the windshield portion.

The "ear front surface" is a human face area including part of cheek bone and is a face in front of the ear.

The support portion has the front edge fastened to the windshield portion and the rear edge brought into contact with the ear front surface in the wearer's human face when the wearer wears the wind noise reduction apparatus.

According to a second aspect of the present disclosure, in the wind noise reduction apparatus, the first surface and the second surface of the windshield portion may have a curved surface that is provided in a middle part in a longitudinal direction of the windshield portion and that is curved to be convex outward relative to the ear front surface in the longitudinal direction.

According to a third aspect of the present disclosure, the wind noise reduction apparatus may further comprise an elastic body provided at the front end of the windshield portion.

According to a fourth aspect of the present disclosure, in the wind noise reduction apparatus, the windshield portion, the support portion and the catching portion may be formed integrally via thin-wall hinges. The windshield portion, the support portion and the catching portion may be configured to be assembled by bending the thin-wall hinges.

According to a fifth aspect of the present disclosure, in the wind noise reduction apparatus, at least two of the windshield portion, the support portion and the catching portion may be provided separately. At least two of the windshield portion, the support portion and the catching portion may be configured to be detachable.

According to a sixth aspect of the present disclosure, in the wind noise reduction apparatus, the front end of the windshield portion may be placed at a distance of 60 mm to 100 mm in a forward direction from an earhole. This configuration enables the windshield portion to cover over the cheek.

According to a seventh aspect of the present disclosure, the wind noise reduction apparatus may further comprise a rectifying structure or a turbulence generating structure that is provided in the second surface of the windshield portion and that includes a plurality of convexes or concaves. This configuration reduces the air eddy generated by the wind hitting against the windshield portion.

Advantageous Effects

The configuration of the first aspect enables the air current from the front end of the windshield portion to be bent outward along the surface of the windshield portion and thereby makes the air flow away from the auricle and the ear canal. This configuration also causes the windshield portion to be supported by the front end of the windshield portion and the support portion. This configuration accordingly suppresses vibration of the windshield portion and reduces the wind noise. When the wearer inserts a chin strap of a helmet through the insertion hole and then tightens the chin strap, an inward vertical stress is generated in the insertion hole by the tension of the chin strap. This presses the front end of the windshield portion and the rear edge of the support portion against the ear front surface and suppresses generation of the wind noise caused by the wind entering the front end of the windshield portion.

The configuration of the second aspect enables the shape of the front end of the windshield portion to be fit to the outline of the ear front surface and suppresses generation of the wind noise caused by the wind entering the front end of the windshield portion.

The configuration of the third aspect enhances the contact between the front end of the windshield portion and the ear front surface. This accordingly enhances the airtightness and suppresses generation of the wind noise caused by the wind entering the front end of the windshield portion.

According to the configuration of the fourth aspect, the windshield portion, the support portion and the catching portion are formed integrally via the thin-wall hinges. This configuration allows for mass production.

According to the configuration of the fifth aspect, at least two of the windshield portion, the support portion and the catching portion are provided separately and in a readily manufacturable shape. This configuration allows for mass production.

The configuration of the sixth aspect suppresses deformation of the air eddy generated in the cheek as well as the periphery of the auricle, thus enhancing the wind noise reduction effect.

The configuration of the seventh aspect provides the rectifying structure or the turbulence generating structure in the second surface of the windshield portion to reduce the generated air eddy. This reduces the energy of the generated wind noise and thus enhances the wind noise reduction effect.

DESCRIPTION OF EMBODIMENTS

Figure 1:
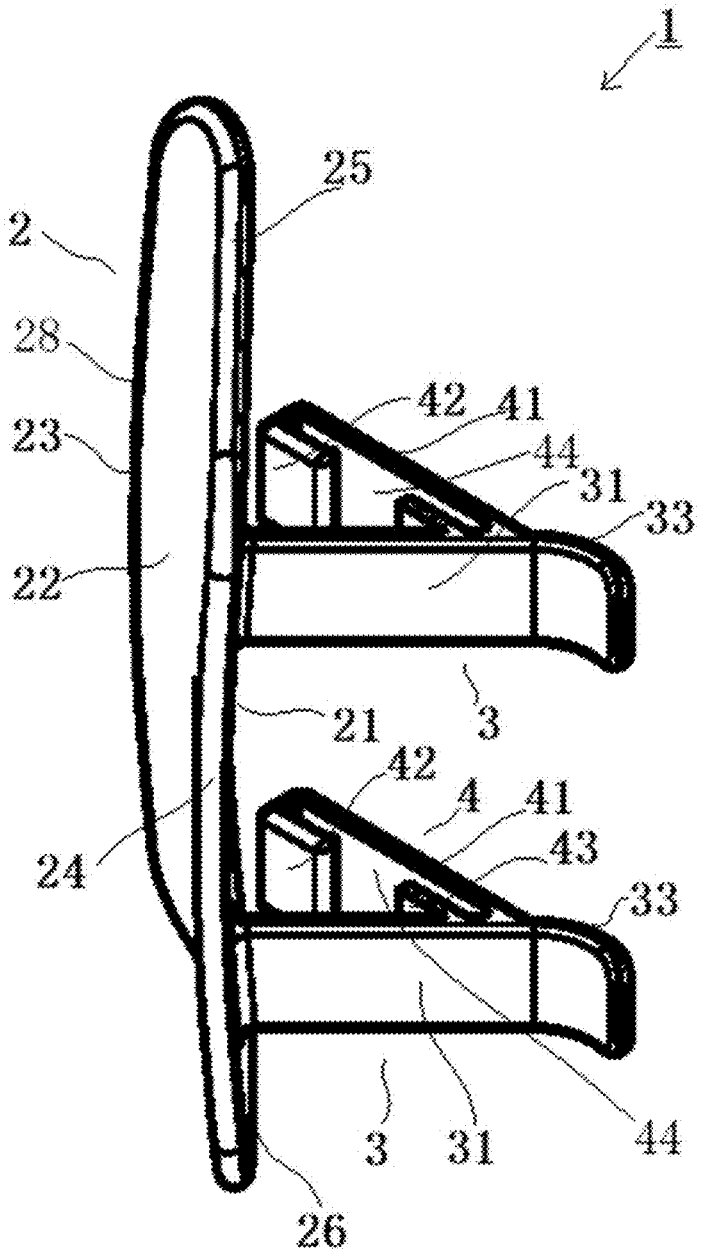
FIG. 1 is a perspective view illustrating a wind noise reduction apparatus viewed from a rear side according to Embodiment 1 of the present disclosure.

The following describes preferable embodiments of the present disclosure with reference to drawings.

As shown in FIG. 1 to FIG. 5, a wind noise reduction apparatus 1 according to Embodiment 1 includes a windshield portion 2 having a front end 23, a rear end 24, an upper end 25, a lower end 26, a first surface 21 arranged to face an ear front surface H, and a second surface 22 arranged on an opposite side to the first surface 21; support portions 3 stood upright from the first surface 21 of the windshield portion 2; and catching portions 4 having insertion holes or insertion openings 44 that are provided to hold a chin strap B of a helmet and that are located between front edges and rear edges 33 of the support portions 3. The following describes the respective components more in detail.

Figure 2:
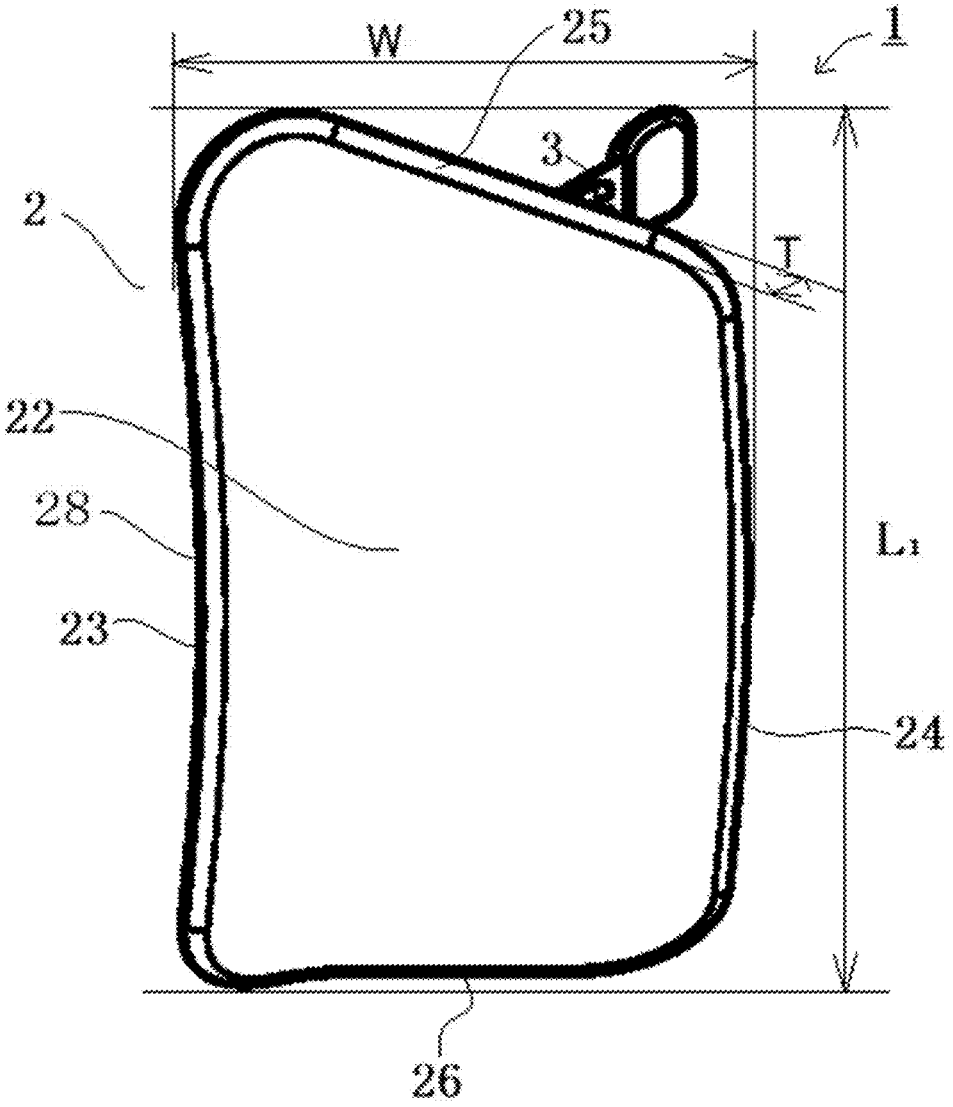
FIG. 2 is a perspective view illustrating the wind noise reduction apparatus viewed from an upper front side according to Embodiment 1 of the present disclosure.
Figure 12:
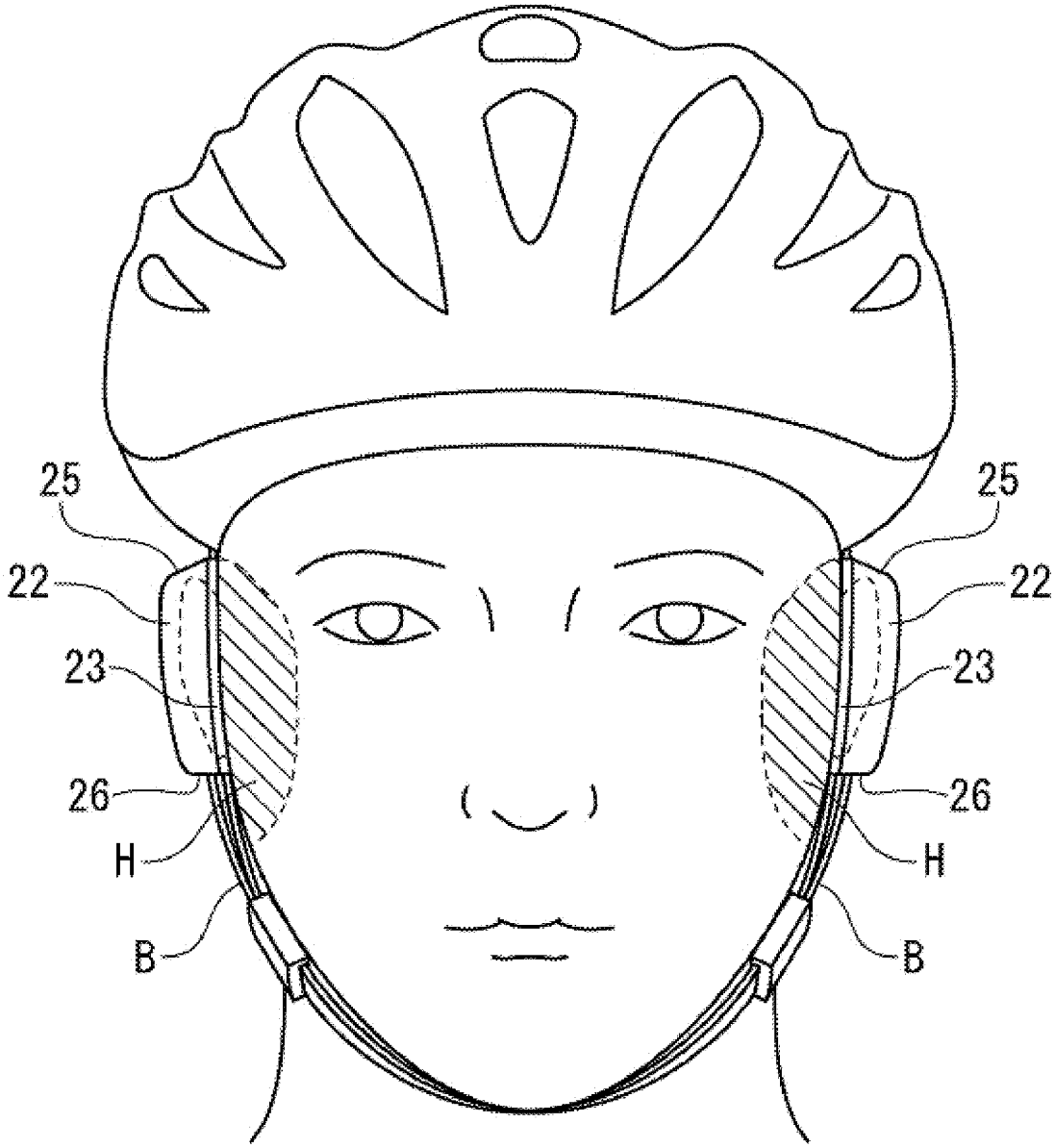
FIG. 12 is a diagram illustrating the wearing state of the wind noise reduction apparatus according to any of Embodiments 1 to 3 of the present disclosure viewed from a front side.

As shown in FIG. 2, the windshield portion 2 is configured by a plate-like body that has a predetermined thickness T and that is defined by the respective sides of the front end 23, the rear end 24, the upper end 25 and the lower end 26. The windshield portion 2 is configured to cover over a wearer's auricle when being viewed from a front side (as shown in FIG. 12). The windshield portion 2 has, for example, a length L1 in a longitudinal direction of 40 to 100 mm, preferably 50 to 90 mm or more preferably 60 to 80 mm and a width W in a short side direction of 20 to 70 mm, preferably 25 to 65 mm or more preferably 30 to 60 mm. The windshield portion 2 having the length L1 of shorter than 40 mm fails to sufficiently cover over the wearer's auricle, whereas the windshield portion 2 having the length L1 of longer than 100 mm is inconvenient in handling. The windshield portion 2 has, for example, a thickness T of 0.5 mm to 4.0 mm, preferably 1.0 mm to 3.0 mm or more preferably 1.5 mm to 2.5 mm. The windshield portion 2 having the thickness T of smaller than 0.5 mm increases the likelihood of vibration caused by the air eddy in the course of protection against the wind, whereas the windshield portion 2 having the thickness T of larger than 4. 0 mm increases the weight of the wind noise reduction apparatus 1 and is inconvenient in handling. The front end 23, the rear end 24, the upper end 25 and the lower end 26 may have a linear configuration or a curved configuration, and the plate-like body may be formed in a rectangular shape, a circulation shape, an elliptical shape, or the like. The plate-like body is preferably a thin plate member and has dimensions of, for example, L1=70 mm, W=35 mm and T=2 mm. The material of the windshield portion 2 is, for example, a thermoplastic resin, although not being limited to this example. The material of the windshield portion 2 may be a metal material or a wood material.

Figure 3:
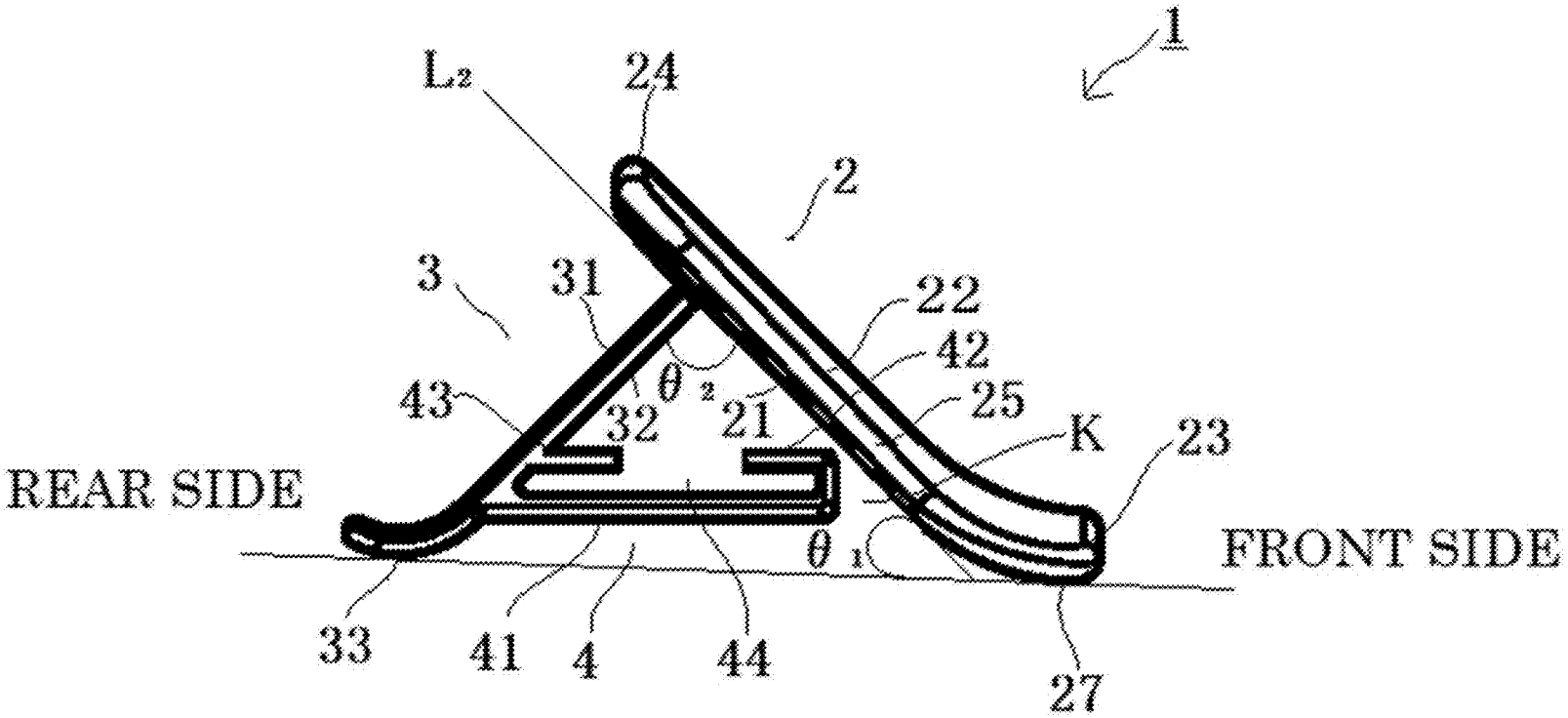
FIG. 3 is a plane view illustrating the wind noise reduction apparatus according to Embodiment 1 of the present disclosure.
Figure 4:
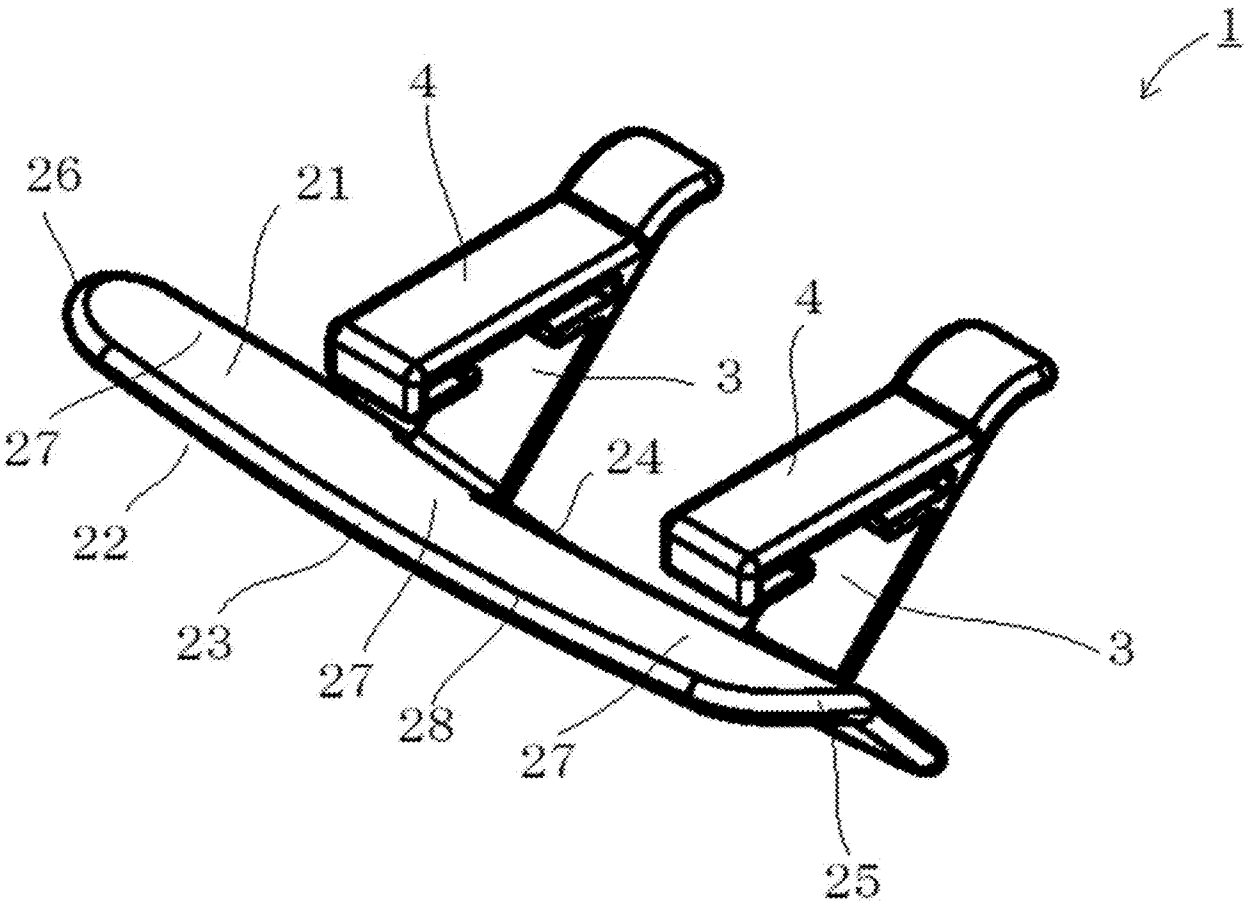
FIG. 4 is a perspective view illustrating the wind noise reduction apparatus viewed from a back side according to Embodiment 1 of the present disclosure.
Figure 5:
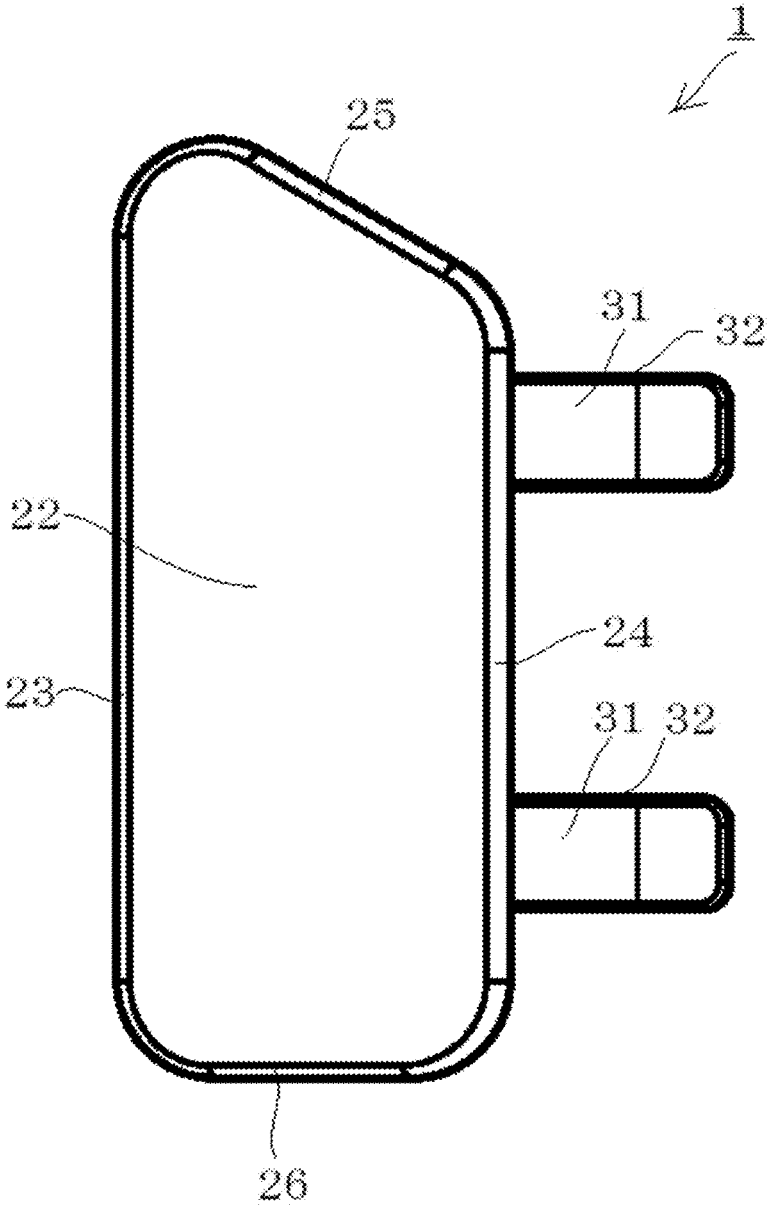
FIG. 5 is a front view illustrating the wind noise reduction apparatus according to Embodiment 1 of the present disclosure.

As shown in FIG. 3 and FIG. 4, the front end 23 of the windshield portion 2 has a contact surface 27 as a curved surface that is recurved to be convex inward in a short side direction thereof relative to the ear front surface H that is in front of the ear and that is a human face area including part of cheekbone. The contact surface 27 is configured to come into contact with the ear front surface H. The configuration of recurving the periphery of the front end 23 of the windshield portion 2 to be convex inward in the short side direction thereof increases the contact area that is in close contact with the ear front surface H and thereby suppresses generation of wind noise caused by the wind entering the front end 23 of the windshield portion 2.

As shown in FIG. 1, FIG. 2 and FIG. 4, the windshield portion 2 has a curved surface 28 that is provided in a middle part in a longitudinal direction thereof and that is curved to be convex outward in the longitudinal direction thereof relative to the ear front surface H, so as to exert the rectifying function. The configuration of forming the periphery of the front end 23 of the windshield portion 2 to be convex outward in the longitudinal direction thereof enables the windshield portion 2 to be fit to the outline of the ear front surface H and enhances the contact between the front end 23 of the windshield portion 2 and the ear front surface H (as shown in FIG. 12).

Providing an elastic body (not shown) at the front end 23 of the windshield portion 2 enhances the contact between the front end 23 and the ear front surface H. The elastic body is, for example, sponge or silicon rubber, although not being limited to these examples. The elastic body may be applied on the front end 23 of the windshield portion 2, or the front end 23 may be made of an elastic body.

The support portions 3 are linear plate-like members extended in a longitudinal direction thereof and have dimensions in the longitudinal direction and a short side direction thereof. The support portion 3 has a length in the longitudinal direction of 10 to 60 mm, for example, 25 mm. The support portion 3 includes a surface 31 and a rear face 32 and has a predetermined thickness. The rear edge 33 of the support portion 3 is recurved to be convex inward relative to the ear front surface H, so as to be in contact with the ear front surface H. The support portion 3 may be formed in a rod-like shape, a plate-like shape or any other suitable shape. The material of the support portions 3 is, for example, a thermoplastic resin, although not being limited to this example. The material of the support portions 3 may be a metal material or a wood material.

As shown in FIGS. 1 to 5, the windshield portion 2 is supported by a three point supporting structure of the contact surface 27 and the pair of rear edges 33. More specifically, the windshield portion 2 is supported by the contact surface 27 of the windshield portion 2 to be in contact with the ear front surface H and the rear edges 33 of the support portions 3 stood upright from the first surface 21 of the windshield portion 2.

As shown in FIG. 3, in plane view, an angle θ1 between a straight line connecting the ear front surface H with the contact surface 27 and the pair of rear edges 33 and a tangent line L2 of the first surface 21 is, for example, 10 to 80 degrees, preferably 20 to 70 degrees or more preferably 30 to 60 degrees. The angle θ1 of less than 10 degrees does not provide a sufficient clearance between the first surface 21 and the wearer's auricle, whereas the angle θ1 of greater than 80 degrees increases the likelihood of vibration caused by the air eddy in the course of protection against the wind. An angle θ2 between the first surface 21 and the longitudinal direction of the support portions 3 is, for example, 60 to 120 degrees, preferably 70 to 110 degrees or more preferably 80 to 100 degrees. The angle θ2 of less than 60 degrees provides a short distance between the first surface 21 and the support portions 3 to have a difficulty in placing the catching portions 4 between the first surface 21 and the support portions 3, whereas the angle θ2 of greater than 120 degrees does not provide a sufficient clearance between the first surface 21 and the wearer's auricle.

As shown in FIG. 3, the catching portions 4 serve to catch a strap of a helmet or the like. The catching portions 4 are linear plate-like members extended in a front-back direction from middle parts of the rear faces 32 of the support portions 3 and have dimensions in a longitudinal direction and in a short side direction and a predetermined thickness. The catching portion 4 includes a plate-like bottom portion 41, a laterally U-shaped hook portion 42 formed by bending rearward from a leading end of the bottom portion 41, and a hook portion 43 formed by protruding from the rear face 32 of the support portion 3 toward an edge of the hook portion 42. The hook portion 42 and the hook portion 43 define the insertion hole or insertion opening 44. The shape of the insertion hole or insertion opening 44 is not limited to a rectangular shape but may be a circular shape or any other suitable shape (not shown). The catching portion 4 may not have an opening K or may have a through hole. The catching portion 4 may employ a snap-on hook structure for catching (not shown). The catching portions 4 may be configured to catch a chin strap B (shown in FIG. 11 and FIG. 12) by a hook and loop fastener (not shown) in place of the insertion hole or insertion opening 44. When the catching portions 4 employ the snap-on hook structure or employ the hook and loop fastener in place of the insertion hole or insertion opening 44 the catching portions 4 may be formed adjacent to the windshield portion 2 or may be formed integrally with the windshield portion 2 (not shown). The catching portion 4 may be formed in a rod-like shape, a plate-like shape or any other suitable shape. The material of the catching portion 4 is, for example, a thermoplastic resin, although not being limited to this example. The material of the catching portions 4 may be a metal material or a wood material.

As shown in FIG. 3, the catching portions 4 are formed to have leading ends separate from the windshield portion 2. The first surface 21, the rear face 32, and the bottom portion 41 define a space having an approximately triangular sectional shape.

As shown in FIG. 3, the catching portions 4 have the insertion holes or insertion openings 44 configured to hold the chin strap B of the helmet and located between the front edges and the rear edges 33 of the support portions 3.

Figure 6:
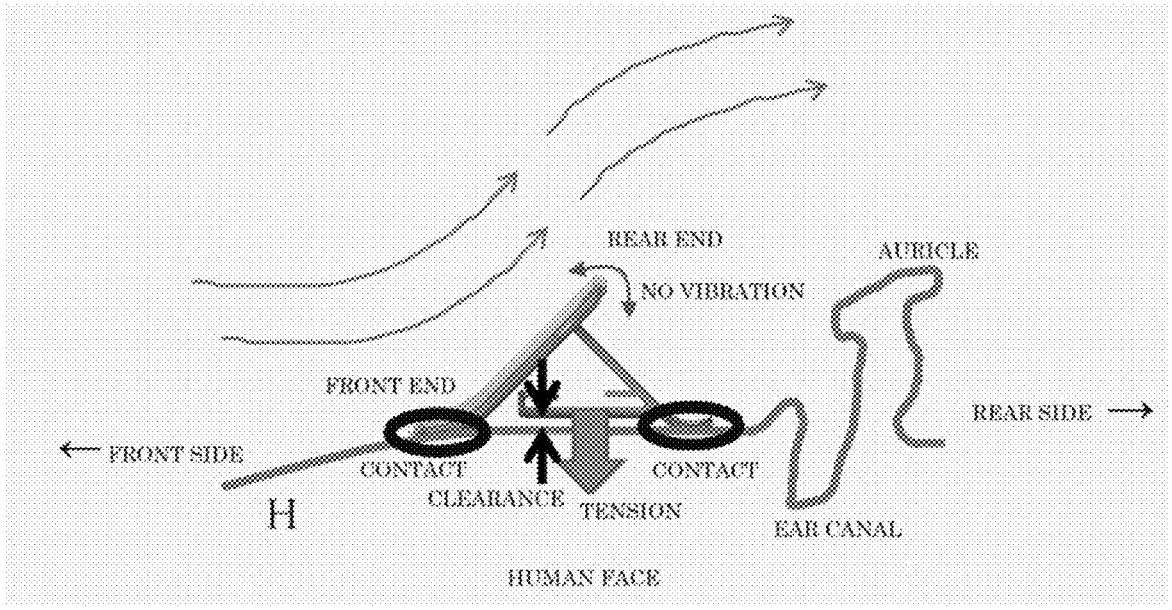
FIG. 6 is a diagram illustrating the functions of the wind noise reduction apparatus according to Embodiment 1 of the present disclosure.

As shown in FIG. 3, the insertion hole or insertion opening 4 is located at a position on a base end side of a leading end of the support portion 3. When the wearer inserts the chin strap B of the helmet through the insertion holes or insertion openings 44 and tightens the chin strap B, a pressing force is applied from the contact surface 27 and the pair of rear edges 33 to the ear front surface H by the tension of the chin strap B (as shown in FIG. 6). There is also a pressing force generated by the wind from the front side.

The following concretely describes one example of a method of using the wind noise reduction apparatus 1 of Embodiment 1 and its functions and advantageous effects with reference to drawings.

Figure 7:
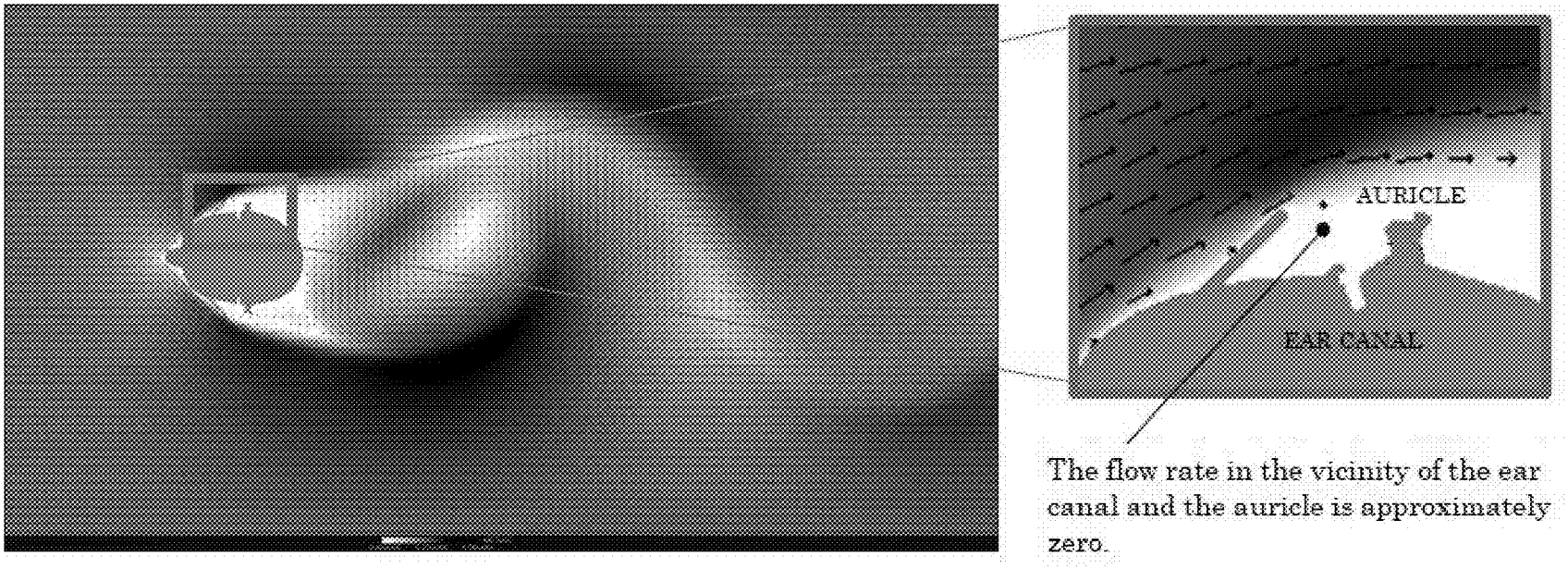
FIG. 7 is a diagram illustrating the flow rate in the periphery of a human head with wearing the wind noise reduction apparatus according to Embodiment 1 of the present disclosure.
Figure 8:
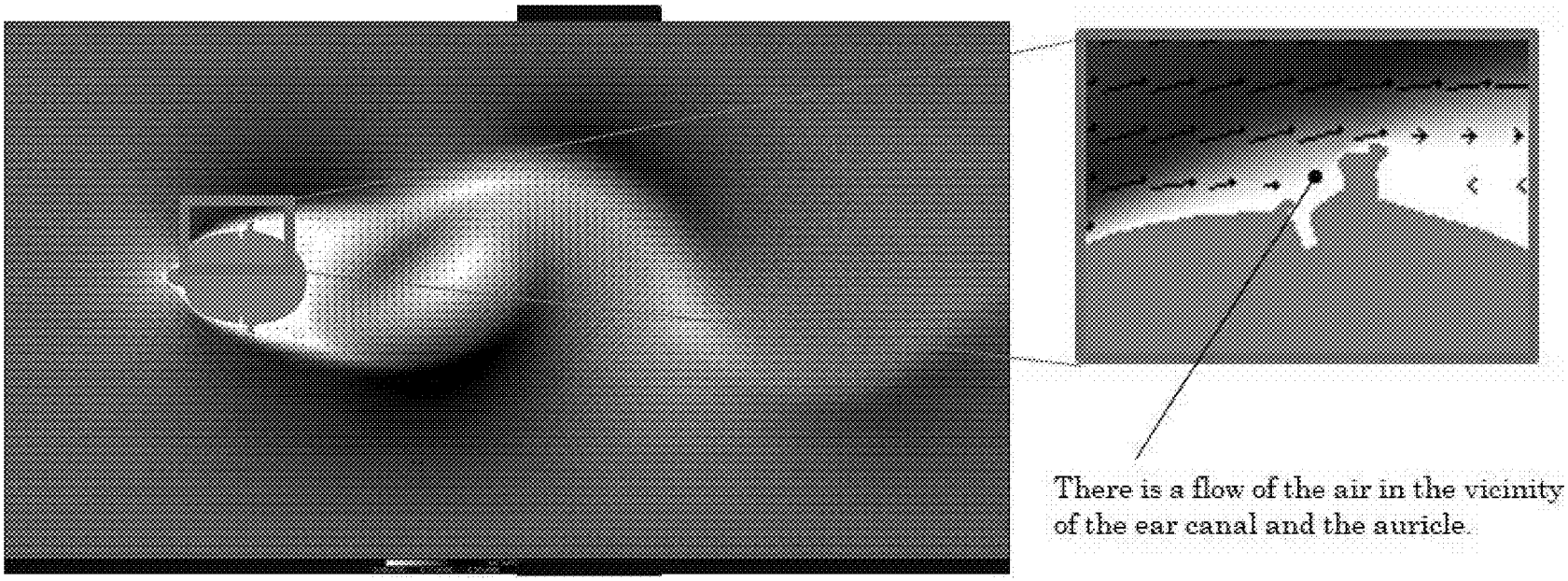
FIG. 8 is a diagram illustrating the flow rate in the periphery of the human head without wearing the wind noise reduction apparatus according to Embodiment 1 of the present disclosure.

According to the present disclosure, as shown in FIG. 7 and FIG. 8, in the case of not wearing the wind noise reduction apparatus 1, the wind from the front side make the flow of the air in the vicinity of the ear canal and the auricle. A pressure fluctuation due to a change in the air eddy hitting against the auricle and various parts of the human head enters the ear canal in the form of noise and is perceived as wind noise (as shown in FIG. 8). In the case of wearing the wind noise reduction apparatus 1, on the other hand, the windshield portion 2 serves to cause the wind from the front side to make the flow of the air away from the ear front surface H but substantially not to make the flow of the air in the vicinity of the ear canal and the auricle. This controls generation of noise caused by a pressure fluctuation due to a change in the air eddy in the vicinity of the ear canal and the auricle and thereby reduces the wind noise (as shown in FIG. 7).

Furthermore, the windshield portion 2 employs the configuration supported by the three or more points of the front end 23, the contact surface 27 that is in contact with the ear front surface H, and the pair of rear edges 33 of the support portions 3. This configuration suppresses vibration in the windshield portion 2 even when the air current from the front side hits against the windshield portion 2 (as shown in FIG. 6) and thereby suppresses propagation of the wind noise caused by the vibration of the windshield portion 2. Accordingly, the configuration of providing only the windshield portion 2 without providing a sound insulating board ensures the sufficient wind noise reducing effect (as shown in FIG. 6, FIG. 7 and FIG. 8). This simplifies the structure and achieves weight reduction, simplification and manufacturing cost reduction.

Figure 11:
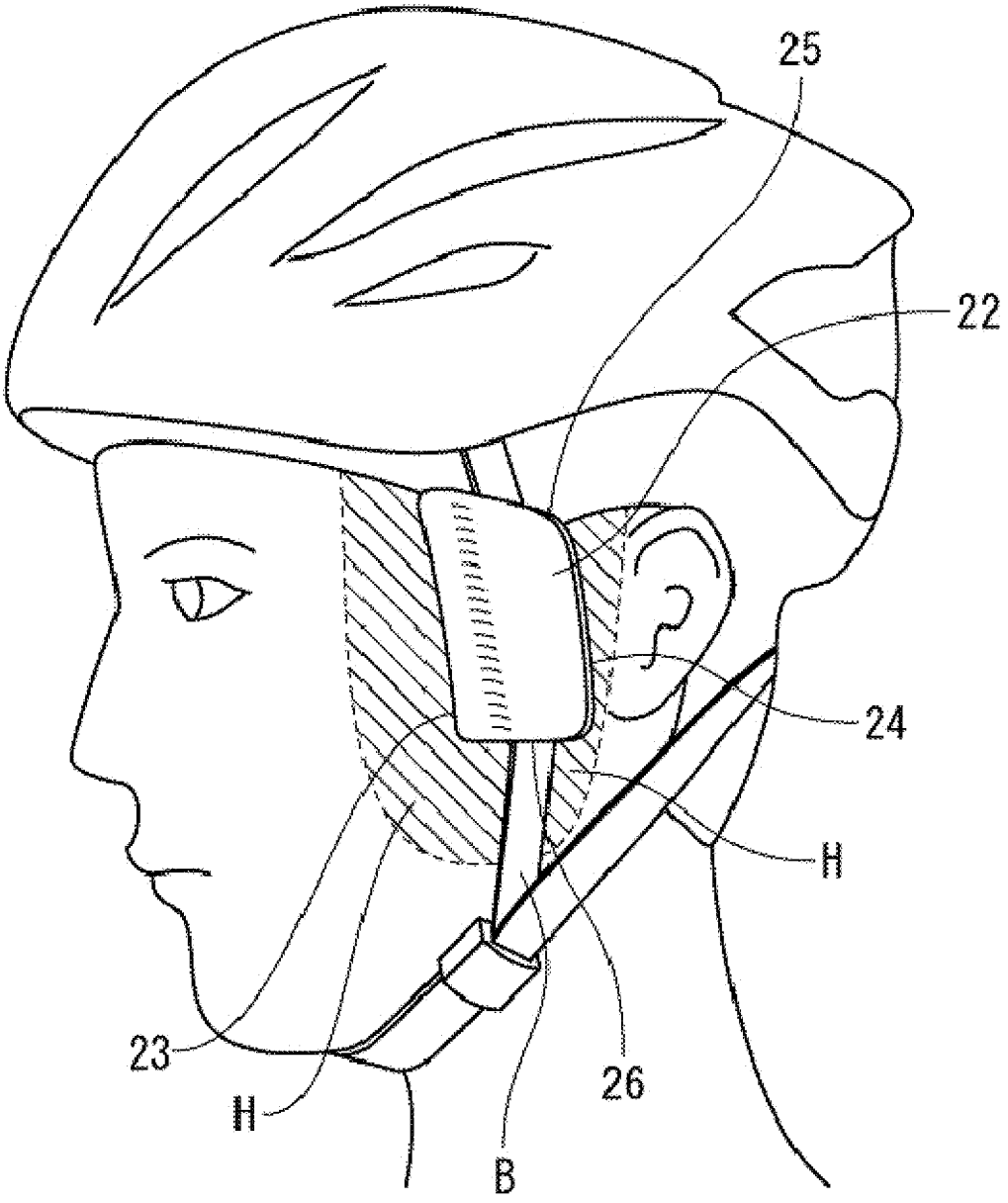
FIG. 11 is a diagram illustrating a wearing state of the wind noise reduction apparatus according to any of Embodiments 1 to 3 of the present disclosure viewed from a lateral side.

As shown in FIG. 1 and FIG. 3, the wearer wears the wind noise reduction apparatus 1 by guiding the chin strap B of the helmet from the opening K between the windshield portion 2 and the catching portions 4 into the apertures of the insertion holes or insertion openings 44 and inserting and catching the chin strap B of the helmet in the apertures of the insertion holes or insertion openings 44. As shown in FIG. 11, the wind noise reduction apparatus 1 is guided by the chin strap B of the helmet and is worn on the ear front surface H of the wearer. The insertion holes or insertion openings 44 are configured to slide the chin strap B vertically, so that the wearing position of the wind noise reduction apparatus 1 is adjustable according to the position of the ear of the wearer to a position having the largest effect of wind noise reduction.

As shown in FIG. 6, when the wearer tightens the chin strap B of the helmet after making the wind noise reduction apparatus 1 caught by the chin strap B, the tension of the chin strap B generates an inward stress in the insertion holes or insertion openings 44, since the insertion holes or insertion openings 44 are located at the position on the base end side of the leading ends of the support portions 3 and are placed away outwardly from the ear front surface H. Accordingly, the front end 23 of the windshield portion 2 and the leading ends of the support portions 3 are pressed against the ear front surface H to be in close contact with the ear front surface H. This configuration suppresses the wind noise reduction apparatus 1 from being shifted during the wearer's long time outdoor activity and enables the wind noise reduction apparatus 1 to stably suppress generation of the wind noise.

As shown in FIG. 1, FIG. 2 and FIG. 4, the middle part in the longitudinal direction of the windshield portion 2 has the curved surface 28 that is curved to be convex outward in the longitudinal direction. This configuration enables the windshield portion 2 to be fit to the outline of the ear front surface H and thereby suppresses the wind noise from being generated by the wind entering the front end 23 of the windshield portion 2. This configuration also reduces the feeling of being pressed when the wearer wears the wind noise reduction apparatus 1 on the ear front surface H and enhances the exhilarating feeling during a sport.

Providing the elastic body at the front end 23 of the windshield portion 2 enhances the airtightness and suppresses generation of the wind noise caused by the wind entering the front end 23 of the windshield portion 2 (not shown). Furthermore, this configuration reduces the feeling of being pressed when the wearer wears the wind noise reduction apparatus 1 on the ear front surface H and enhances the exhilarating feeling during a sport.

As shown in FIG. 3, the front end 23 of the windshield portion 2 is formed to be convex inward in the short side direction thereof relative to the ear front surface H that is in front of the ear and that is the human face area including part of cheekbone. This configuration increases the contact area in the vicinity of the front end 23 of the windshield portion 2 to be in close contact with the ear front surface H and thereby suppresses generation of the wind noise caused by the wind entering the front end 23 of the windshield portion 2. Moreover, this configuration relieves the concentration of stress in the ear front surface H and improves the comfortableness.

As shown in FIG. 11 and FIG. 12, the peripheries of the ear canals and the auricles of the wearer are exposed to the outside air. The ambient sound accordingly reaches the wearer's ear canals without attenuation and without interference or resonance. This accordingly does not significantly change a head-related transfer function relating to the wearer's sound localization. In other words, this does not damage the localization of sounds. Since this configuration does not damage the localization of sounds, the wind noise reduction apparatus 1 ensures smooth communication, for example, during bicycle touring and enables the wearer to readily recognize the direction and the distance of a danger, for example, a vehicle approaching behind.

Figure 9:
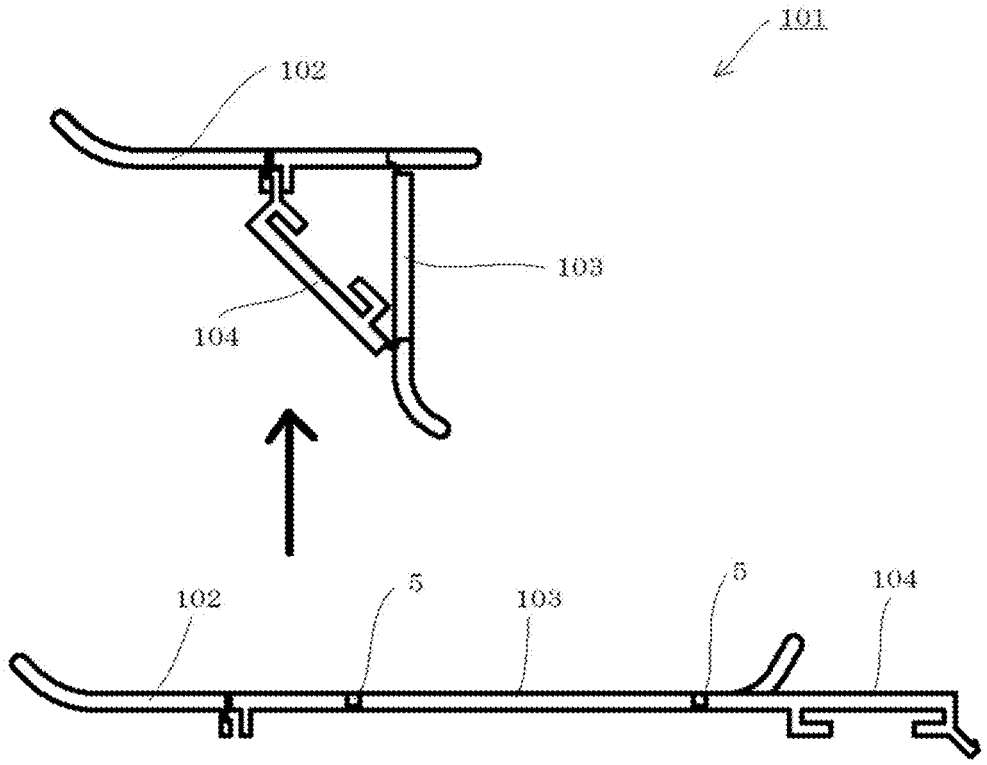
FIG. 9 is a conceptual view illustrating a wind noise reduction apparatus configured via a hinge element according to Embodiment 2 of the present disclosure.

A wind noise reduction apparatus 101 according to Embodiment 2 is configured by integrally forming a windshield portion 102 with supporting portions 103 and catching portions 104 via thin-wall hinges 5 as shown in FIG. 9. The illustration and the description of Embodiment 1 are applied to the configuration of Embodiment 2 that is similar to the configuration of Embodiment 1. The wind noise reduction apparatus 101 is preferably configured such that the windshield portion 102 can be assembled with the support portions 103 and the catching portions 104 by bending the thin-wall hinges 5. It is preferable to mold the wind noise reduction apparatus 101 by injection molding of a thermoplastic resin as the material. The material is, however, not limited to the thermoplastic resin, and the molding technique employed may be compression molding or another molding method. This configuration enables the respective parts of the wind noise reduction apparatus 101 described above to be manufactured integrally by using a simple die. This accordingly allows for mass production and reduces the cost.

Figure 10:
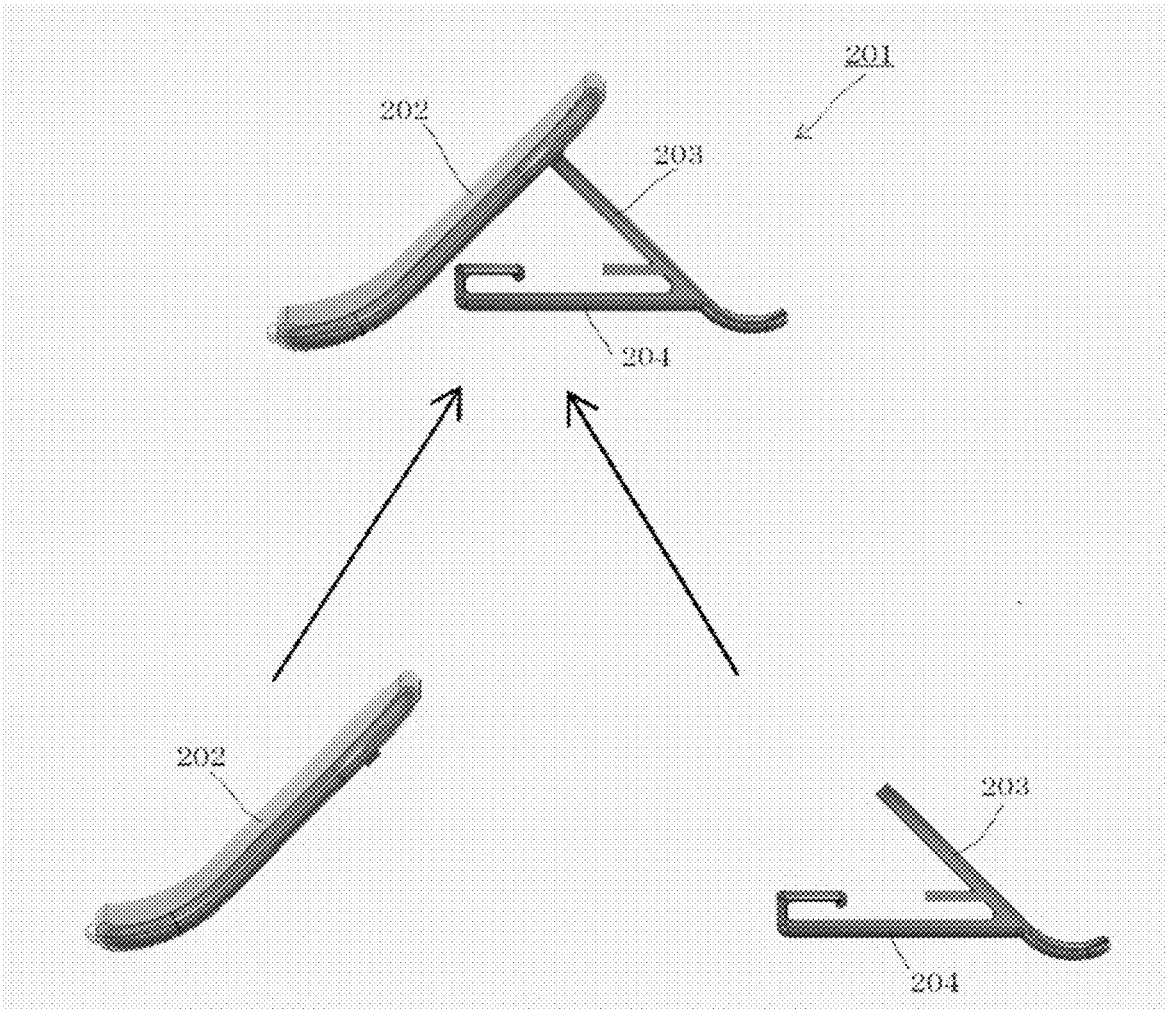
FIG. 10 is a conceptual view illustrating a wind noise reduction apparatus configured to be separable according to Embodiment 3 of the present disclosure.

A wind noise reduction apparatus 201 according to Embodiment 3 is configured by separately forming a windshield portion 202 and supporting portions 203 provided with catching portions 204 and subsequently fastening and assembling the windshield portion 202 to and with the supporting portions 203 provided with the catching portions 204 as shown in FIG. 10. The illustration and the description of Embodiment 1 are applied to the configuration of Embodiment 3 that is similar to the configuration of Embodiment 1, and a difference from the configuration of Embodiment 1 is described. The fastening technique employed may be engagement by a claw structure or screwing by a screw structure. This configuration enables the windshield portion 202 and the supporting portions 203 provided with the catching portions 204 to be produced simultaneously in production lines using different simple dies. This accordingly increases the production efficiency and reduces the cost.

Figure 13:
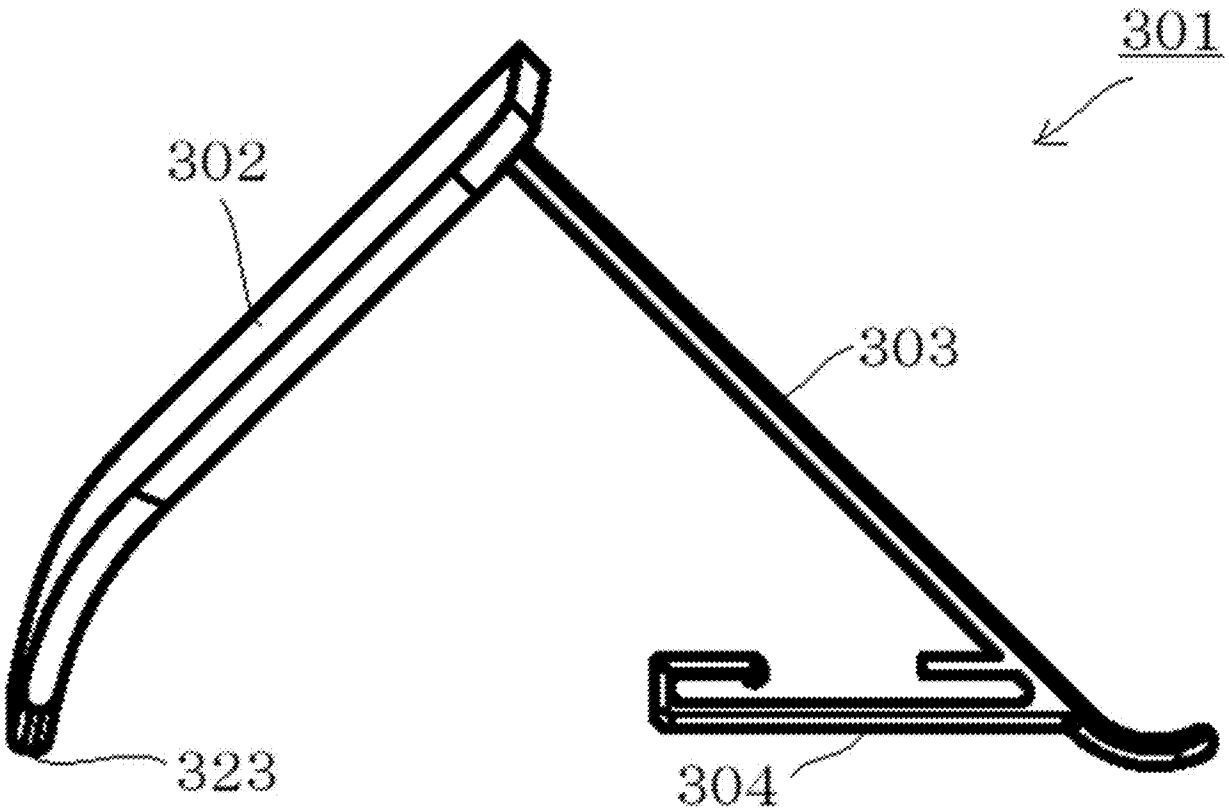
FIG. 13 is a plane view illustrating a wind noise reduction apparatus according to Embodiment 4 of the present disclosure.
Figure 14:
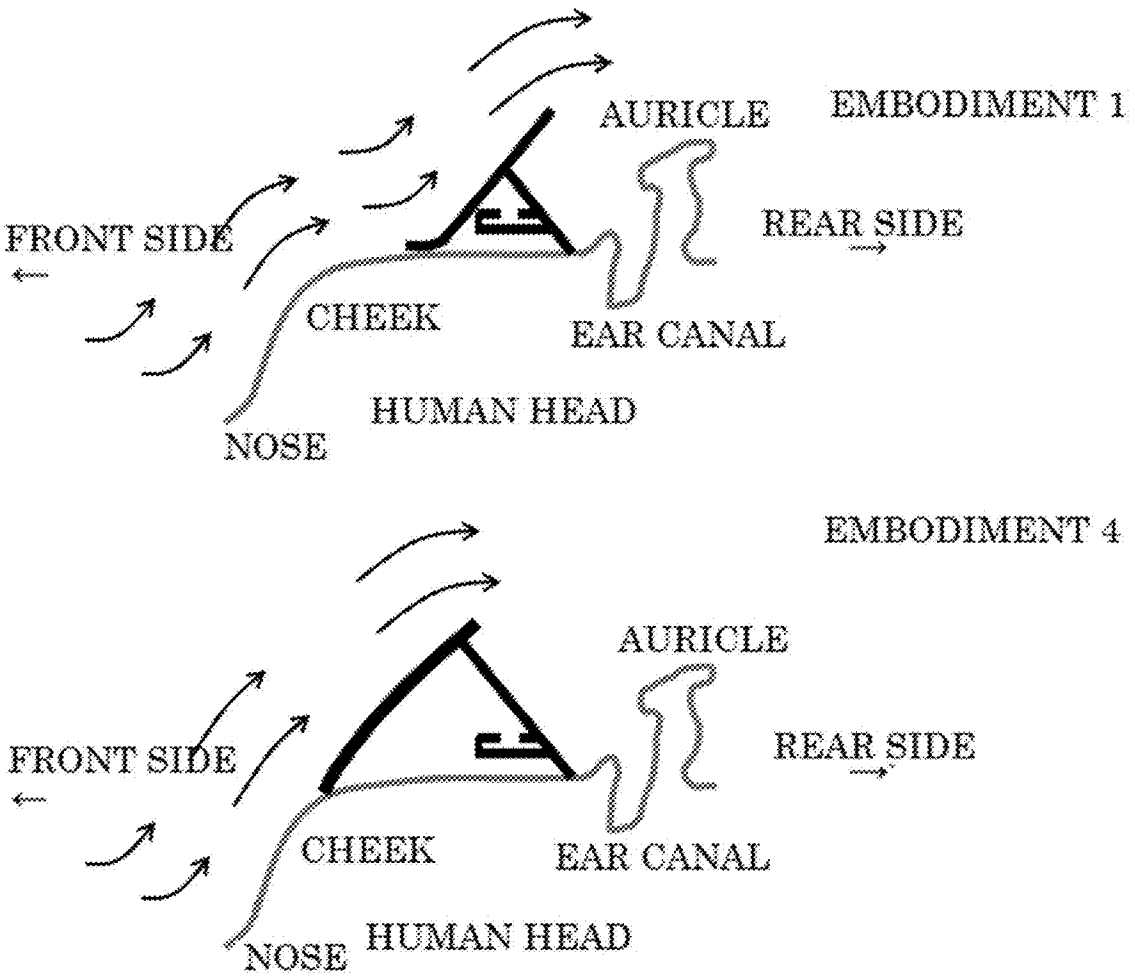
FIG. 14 is a diagram illustrating the flow of the air current around the wind noise reduction apparatus according to Embodiment 4 of the present disclosure.
Figure 15:
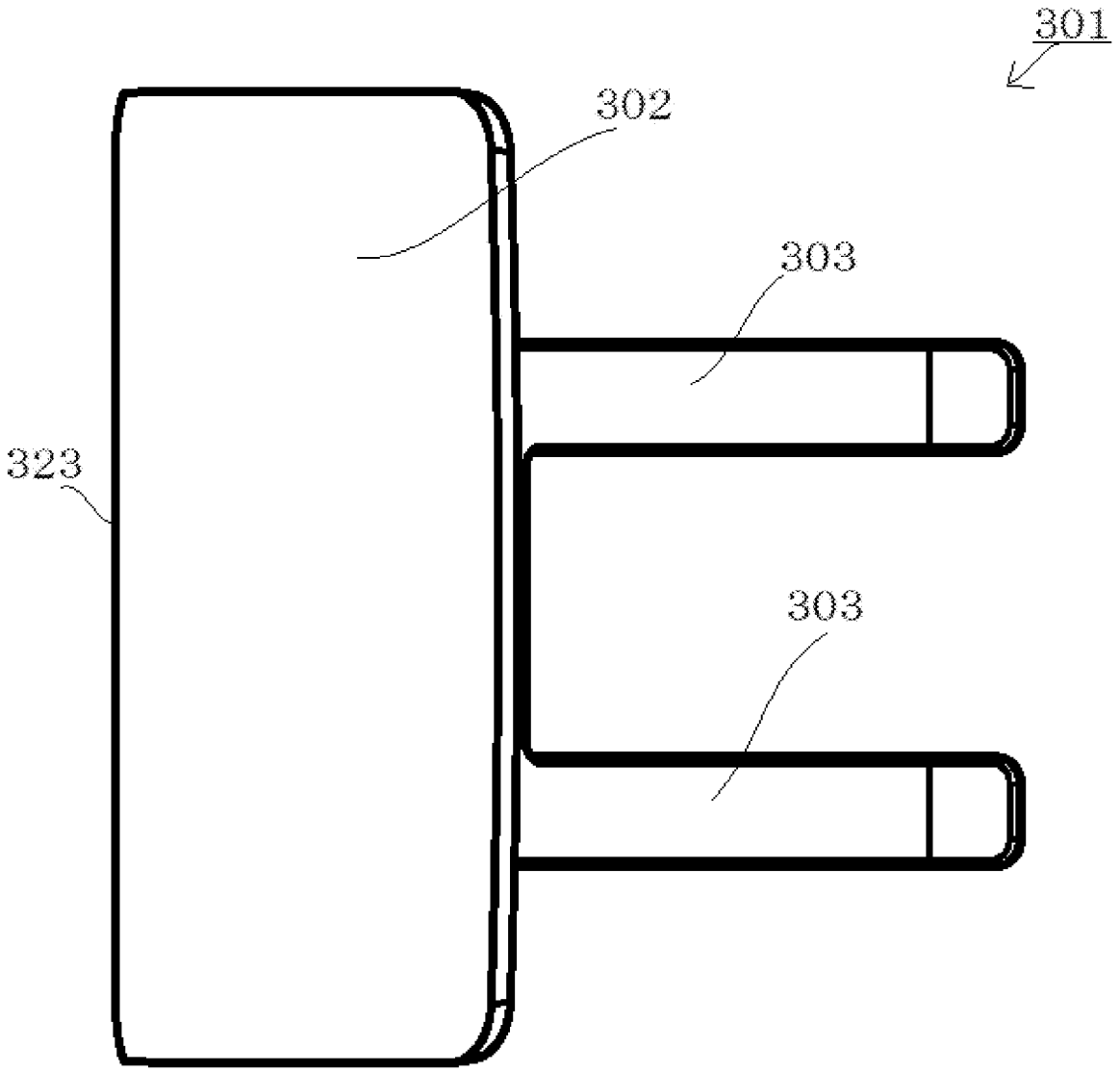
FIG. 15 is a front view illustrating the wind noise reduction apparatus according to Embodiment 4 of the present disclosure.

The following describes a wind noise reduction apparatus 301 according to Embodiment 4. The illustration and the description of Embodiment 1 are applied to the configuration of Embodiment 4 that is similar to the configuration of Embodiment 1, and a difference from the configuration of Embodiment 1 is described. According to Embodiment 1, the windshield portion 2 is located in the ear front surface H that is in front of the ear and that is the human face area including part of cheekbone (as shown in FIG. 11). According to Embodiment 4, on the other hand, as shown in FIGS. 13 to 15, a front end 323 of a windshield portion 302 is placed at a distance of 60 mm to 100 mm in a forward direction from an earhole. This configuration reduces a level difference from the cheek curved surface and additionally suppresses deformation of the air eddy occurring in a location having a level difference. This further enhances the wind noise reduction effect (as shown in FIG. 14).

Figure 16:
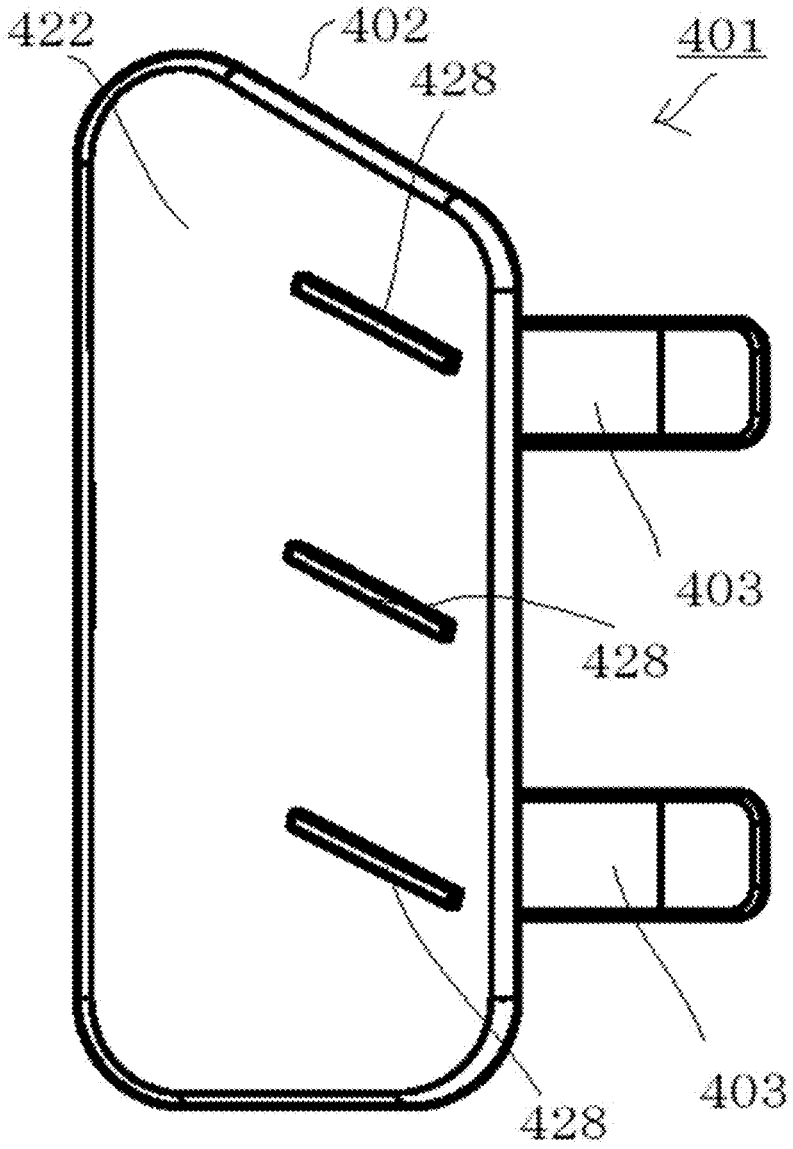
FIG. 16 is a front view illustrating a wind noise reduction apparatus according to Embodiment 5 of the present disclosure.

The following describes a wind noise reduction apparatus 401 according to Embodiment 5. The illustration and the description of Embodiment 1 are applied to the configuration of Embodiment 5 that is similar to the configuration of Embodiment 1, and a difference from the configuration of Embodiment 1 is described. According to Embodiment 1, the windshield portion 2 is formed to have a smooth surface or a continuous surface. According to Embodiment 5, on the other hand, as shown in FIG. 16, a plurality of fins 428 serving as a rectifier or a turbulence generator are provided at predetermined intervals to be arranged obliquely upward in a short side direction on a second surface 422 of a windshield portion 402. The number of the fins 428 is three in the illustrated example, although the number of the fins 428 is not limited to this example. The configuration of providing the fins 428 provides a level difference from the second surface 422 and accordingly further reduces the size of the eddy formed in the air current flowing outside of the second surface 422 of the windshield portion 402.

Figure 17:
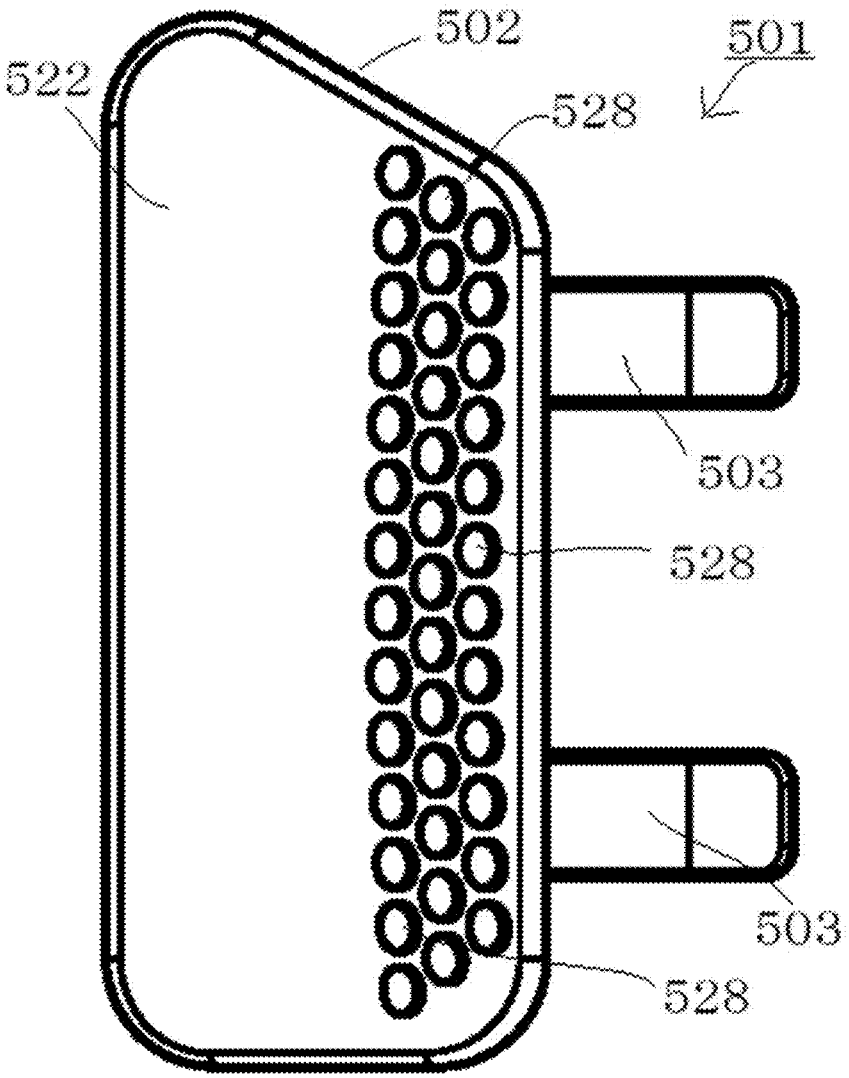
FIG. 17 is a front view illustrating a wind noise reduction apparatus according to Embodiment 6 of the present disclosure.

The following describes a wind noise reduction apparatus 501 according to Embodiment 6. The illustration and the description of Embodiment 1 are applied to the configuration of Embodiment 6 that is similar to the configuration of Embodiment 1, and a difference from the configuration of Embodiment 1 is described. As shown in FIG. 17, a plurality of convexes 528 serving as a rectifier or a turbulence generator are provided in a dot-like pattern in a rear area in a short side direction of a second surface 522 of a windshield portion 502. The number of the convexes 528 is thirty nine in the illustrated example, although the number of the convexes 528 is not limited to this example. The convex 528 may be replaced by a recess or concave. The configuration of providing the convexes 528 provides a level difference from the second surface 522 and accordingly further reduces the size of the eddy formed in the air current flowing outside of the second surface 522 of the windshield portion 502. The thickness of the convexes 528 is preferably smaller than the thickness T of the plate-like body. The convexes 528 or the concaves 528 may have the dimensions and the shape varied according to their positions and may be formed in any of various sizes of a columnar shape, a hexagonal prisms shape, a triangular prism shape, a quadrangular prism shape, a spherical shape, an oval spherical shape or the like.

The configurations shown in FIG. 16 and FIG. 17 reduce the eddies generated in the air current flowing outside of the second surface 422 or 522 of the windshield portion 402 or 502. This changes the frequency of the wind noise generated in the windshield portion 402 or 502 to the higher frequency and reduces the energy in frequency bands of the engine noise of approaching vehicles and the human conversation, thereby facilitating the wearer to hear required information. This function follows the Kolmogorov's minus five thirds ($-5/3$) power law, which decreases the energy of an eddy with an increase in wave number of the eddy (reciprocal of the diameter of the eddy). This function reduces a stress applied from the windshield portion 402 or 502 to the air current and reduces deformation of the eddy, so as to reduce the wind noise. This function is applied to the wind noise reduction apparatuses 401 and 502 of Embodiments 5 and 6.

Providing the plurality of fins 428 in the windshield portion 402 of the wind noise reduction apparatus 401 or providing the plurality of convexes 528 or the like in the windshield portion 501 of the wind noise reduction apparatus 501 like Embodiments 5 and 6 enhances the fashionability as well as the functionality and provides the outdoor actions with fun.

Figure 18:
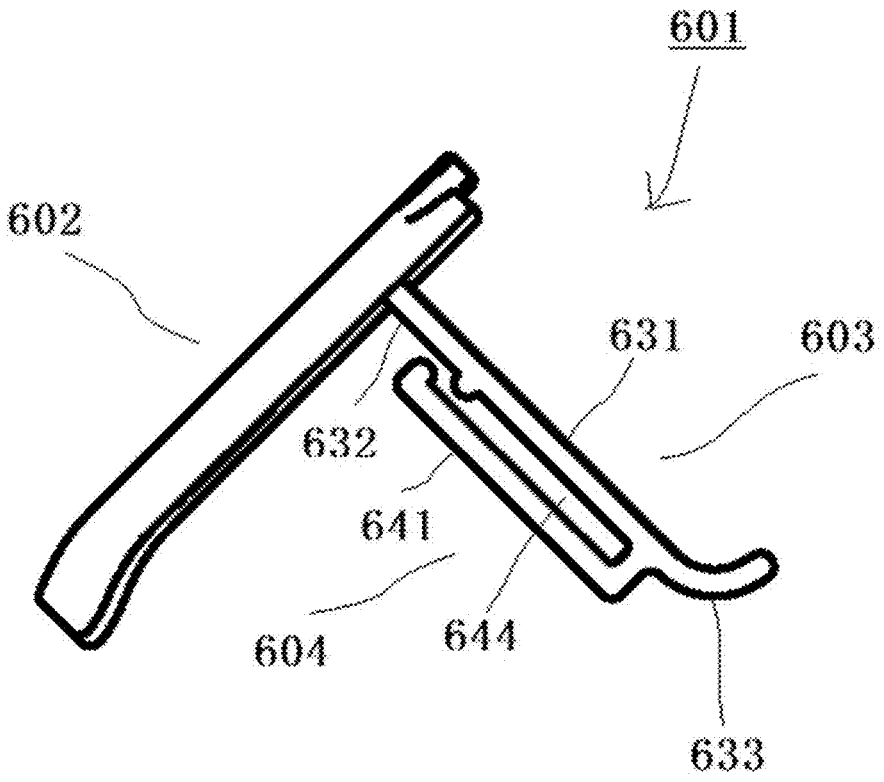
FIG. 18 is a front view illustrating a wind noise reduction apparatus according to Embodiment 7 of the present disclosure.

The following describes a wind noise reduction apparatus 601 according to Embodiment 7. The illustration and the description of Embodiment 1 are applied to the configuration of Embodiment 7 that is similar to the configuration of Embodiment 1, and a difference from the configuration of Embodiment 1 is described. As shown in FIG. 18, a catching portion 604 is provided between a front edge and a rear edge 633 of a support portion 603 that is stood upright from a windshield portion 602. The catching portion 604 has an insertion hole 644 defined by a surface 631 and a rear face 632 of the support portion 603 and a bottom portion 641 of the catching portion 604. The wearer slides and inserts a chin strap B of a helmet from a wind shield portion 602-side opening of the catching portion 604. This simplifies the configuration and facilitates production.

Figure 19:
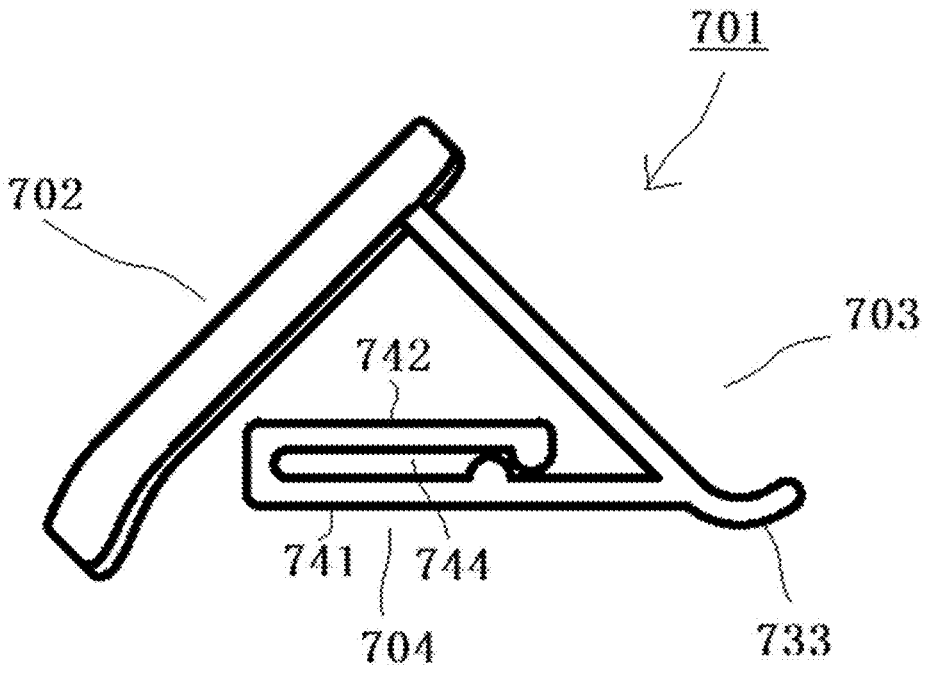
FIG. 19 is a front view illustrating a wind noise reduction apparatus according to Embodiment 8 of the present disclosure.

The following describes a wind noise reduction apparatus 701 according to Embodiment 8. The illustration and the description of Embodiment 1 are applied to the configuration of Embodiment 8 that is similar to the configuration of Embodiment 1, and a difference from the configuration of Embodiment 1 is described. As shown in FIG. 19, a catching portion 704 is provided between a front edge and a rear edge 733 of a support portion 703 that is stood upright from a windshield portion 702. The catching portion 704 has an insertion hole 744 defined by a laterally U-shaped hook portion 742 of the catching portion 704 and a bottom portion 741 of the catching portion 704. The wearer slides and inserts a chin strap B of a helmet from a support portion 703-side opening of the catching portion 704.

Figure 20:
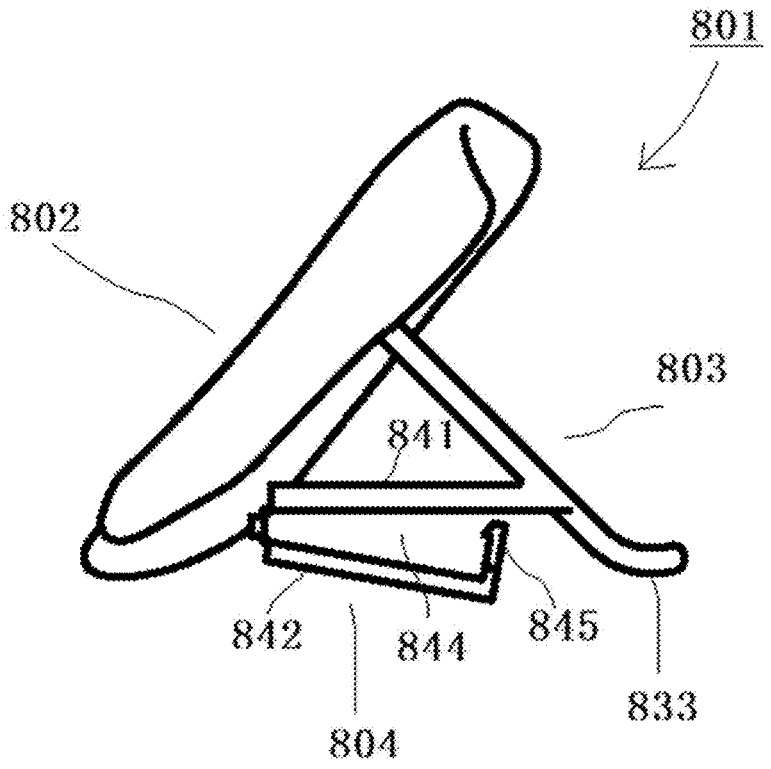
FIG. 20 is a front view illustrating a wind noise reduction apparatus according to Embodiment 9 of the present disclosure.

The following describes a wind noise reduction apparatus 801 according to Embodiment 9. The illustration and the description of Embodiment 1 are applied to the configuration of Embodiment 9 that is similar to the configuration of Embodiment 1, and a difference from the configuration of Embodiment 1 is described. As shown in FIG. 20, a catching portion 804 is provided between a front edge and a rear edge 833 of a support portion 803 that is stood upright from a windshield portion 802. The catching portion 804 has an insertion hole 844 defined by a laterally U-shaped hook portion 842 of the catching portion 804 and a bottom portion 841 of the catching portion 804. The wearer inserts a chin strap B of a helmet through the insertion hole 844 of the catching portion 804 and fits a claw 845 formed at a leading end of the laterally U-shaped hook portion 842 of the catching portion 804 in a fitting element (not shown) formed in the bottom portion 841 of the catching portion 804, so as to catch the chin strap B of the helmet. This configuration facilitates catching of the chin strap B of the helmet.

The present disclosure is not limited to the embodiments described above but may be implemented by any of various other aspects within the scope of the present disclosure. There may also be various changes, modifications and the like within the scope of the present disclosure. Such changes, modifications, their equivalents and the like are also included in the scope of the present disclosure. For example, a rectangular opening is illustrated as the insertion hole. The shape of the insertion hole is, however, not limited to a rectangular shape. The insertion hole may employ a snap-on-hook structure without an opening. The fins and the convexes or the like in a dot-like pattern are only illustrative as the examples of the rectifying structure provided in the windshield portion. Those skilled in the art can naturally employ any of various structures to reduce the eddy generated in the air current and any of various structures for the convenience of use to provide the windshield portion with a cut for the rod of eyeglasses.

INDUSTRIAL APPLICABILITY

The present disclosure provides a wind noise reduction apparatus configured to include a windshield portion that is supported by a front end thereof and respective ends of support portions to reduce vibration and that has excellent vibration damping property and to exert large advantageous effects by the simple structure. The present disclosure accordingly has high industrial potential.

REFERENCE SIGNS LIST

1, 101, 201, 301, 401, 501, 601, 701, 801 wind noise reduction apparat
2, 102, 202, 302, 402, 502, 602, 702, 802 windshield portion
21 first surface
22, 422, 522 second surface
23, 323 front end
24 rear end
25 upper end
26 lower end
27 contact surface of the front end of the windshield portion to be in contact with an ear front surface H
28 curved surface provided in a middle part in a longitudinal direction of the windshield portion and curved to be convex outward
428 fin
528 convex or concave
3, 103, 203, 303, 403, 503, 603, 703, 803 support portion
31, 631 surface of the support portion
32, 632 rear face of the support portion
33, 633, 733, 833 rear edge of the support portion
4, 104, 204, 604, 704, 804 catching portion

41, 641, 741, 841 bottom portion of the catching portion
42, 742, 842 laterally U-shaped hook portion
43 hook portion protruded to be formed
44, 644, 744, 844 insertion hole or insertion opening
845 claw on a leading end of the hook portion
5 thin-wall hinge
θ1 angle between a straight line connecting a contact surface of the windshield portion with contact surfaces of the support portions and a tangent line of the first surface of the windshield portion
θ2 angle between the first surface of the windshield portion and a longitudinal direction of the support portions
H human face area that is in front of the ear and that includes part of cheek bone
L1 length in a longitudinal direction of the windshield portion 2
L2 tangent line of the first surface 21
W width in a short side direction of the windshield portion 2
T thickness of the windshield portion
K opening of the catching portion
B chin strap of a helmet

What is claimed is:

1. A wind noise reduction apparatus, comprising:

a windshield portion having a front end, a rear end, an upper end, a lower end, a first surface arranged for facing an ear front surface of a human face, and a second surface arranged on an opposite side to the first surface, wherein an upper side, a lower side, a front side, a rear side, an inner side and an outer side configured to be specified by directions relative to a human head;

one or multiple support portions stood upright from the first surface and configured to support the windshield portion; and a catching portion placed between one end of the support portion that is connected with the first surface and the other end of the support portion that is arranged on an opposite side to the one end, wherein an insertion hole or insertion opening used to hold a chin strap of a helmet is placed in the catching portion.

2. The wind noise reduction apparatus according to claim 1, wherein the windshield portion, the support portion and the catching portion are formed integrally via thin-wall hinges, and the windshield portion, the support portion and the catching portion are configured to be assembled by bending the thin-wall hinges.

3. The wind noise reduction apparatus according to claim 1, wherein at least two of the windshield portion, the support portion and the catching portion are provided separately, and at least two of the windshield portion, the support portion and the catching portion are configured to be detachable.

4. The wind noise reduction apparatus according to claim 1, wherein the front end of the windshield portion configured to be placed at a distance of 60 mm to 100 mm in a forward direction from an earhole.

5. The wind noise reduction apparatus according to claim 1, further comprising a rectifying structure or a turbulence generating structure that is provided in the second surface of the windshield portion and that includes a plurality of convexes or concaves.

6. The wind noise reduction apparatus according to claim 1, wherein the first surface and the second surface of the windshield portion have a curved surface that is provided in a middle part in a longitudinal direction of the windshield portion and that is curved to be convex outward relative to the ear front surface in the longitudinal direction.

* * * * *